US005984573A

United States Patent [19]

Smith

[11] Patent Number: 5,984,573

[45] Date of Patent: Nov. 16, 1999

[54] PROCESS FOR FORMING WATERING NOTCHES IN AN IRRIGATION DITCH AND APPARATUS ADAPTED FOR USE WITH THE PROCESS

[76] Inventor: Don Paul Smith, 2000 N. Eighth Ave., Safford, Ariz. 85546

[21] Appl. No.: 08/883,683

[22] Filed: Jun. 27, 1997

Related U.S. Application Data

[63] Continuation of application No. 08/496,922, Jun. 30, 1995, abandoned.

[51] Int. Cl.[6] ..... E02B 13/00

[52] U.S. Cl. ..... 405/36

[58] Field of Search ..... 405/36, 108, 268; 269/9–13; 425/59, 63

[56] References Cited

U.S. PATENT DOCUMENTS

| | | | |
|---|---|---|---|
| 315,629 | 4/1885 | Jessup | 405/39 |
| 3,410,094 | 11/1968 | Shelley | 405/39 |
| 4,352,593 | 10/1982 | Iskra et al. | 405/108 |
| 5,248,217 | 9/1993 | Smith | 405/36 |

OTHER PUBLICATIONS

U.S. Department of Interior–Bureau of Reclamation, Design of Small Dams, 3rd. Ed., p. 339, 1987.

*Primary Examiner*—William Neuder
*Assistant Examiner*—Tara L. Mayo
*Attorney, Agent, or Firm*—Martin & Associates, L.L.C.; Derek P. Martin

[57] ABSTRACT

Apparatus and process for forming watering notches through a sidewall of a conventional irrigation ditch.

12 Claims, 2 Drawing Sheets

PROCESS FOR FORMING WATERING NOTCHES IN AN IRRIGATION DITCH AND APPARATUS ADAPTED FOR USE WITH THE PROCESS

This is a continuation of application Ser. No. 08/496,922 filed Jun. 30, 1995, now abandoned.

TECHNICAL FIELD

This invention relates generally to concrete irrigation ditches, and more specifically to irrigation ditches having watering notches. Still more specifically, the invention relates to a process for forming watering notches in a conventional irrigation ditch, and to a marking apparatus adapted for use with the process.

BACKGROUND OF THE INVENTION

Notched irrigation ditches are illustrated in U. S. Pat. Nos. 3,410,094 Shelley and 5,248,217 Smith. The watering notches in such ditches are formed by pressing an appropriately shaped device into the freeboard while the freeboard is uncured. The notches are equally spaced, and they are formed to a depth which is determined by use of a construction laser which transmits an optical signal to a receiver, the latter being mounted on the notch-forming device.

The construction of notched irrigation ditches as described in the forementioned patents is relatively expensive, but is often justified by more uniform watering, and by the elimination of activity which accompanies the use of conventional irrigation ditches (e.g., placement and removal of hoses). Many farmers who already have conventional irrigation ditches face the additional expense of removing their existing ditches if they want the more efficient notched ditches installed. Accordingly, there is a need to provide some farmers with the ability to realize the advantages associated with notched irrigation ditches, while avoiding the expense associated with ditch removal and reformation.

As is more particularly described below, this invention meets the above-stated need by providing a process for converting conventional irrigation ditches to notched irrigation ditches. The invention also provides apparatus for facilitating the process.

SUMMARY OF THE INVENTION

In the process according to the invention, the inner wall of a conventional concrete irrigation ditch is marked at a plurality of spaced locations near the top edge of the ditch. The marks are made in such manner as to correspond to the desired shape of watering notches to be formed through the inner wall, and are thus made where the ditch faces the field to be irrigated. In order to provide for uniform watering, the positions at which the marks are to be made are optically determined by conventional means so that the bottoms of the watering notches will be level to within about a quarter of an inch. The marks are then made at these locations by pressing a suitably formed plate against the inner wall so that it intersects the top edge of the ditch, and either drawing on the wall along the periphery of the plate, or spray-painting the wall using the plate as a shield. A suitable cutting device, such as an electrically powered rotary saw with a diamond-tipped blade, is then used to saw through the inner wall at the marked locations to convert the conventional ditch into a notched ditch.

The invention also provides apparatus for determining shapes and locations of the watering notches formed through the inner wall. An apparatus according to the invention comprises a plate having a peripheral form which corresponds at least in part to the shape of the notches. The plate typically includes two convergent edges and may be trapezoidal in form. The apparatus also comprises an elongated handle, and interconnecting means for fixing the handle to the plate at an angle which depends on the angle of the inner wall of the ditch. The handle should be long enough to serve the purpose of holding the plate against the inner wall while simultaneously allowing for the mounting of an optical receiver thereon.

DESCRIPTION OF THE PREFERRED EMBODIMENT

Figure 1:
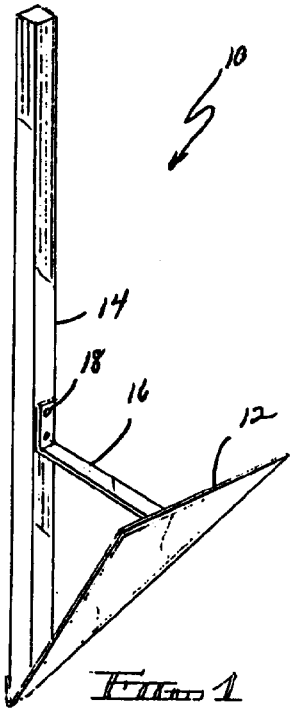
FIG. 1 is a perspective view of an apparatus for determining shapes and locations of watering notches in accord with the invention.
Figure 2:
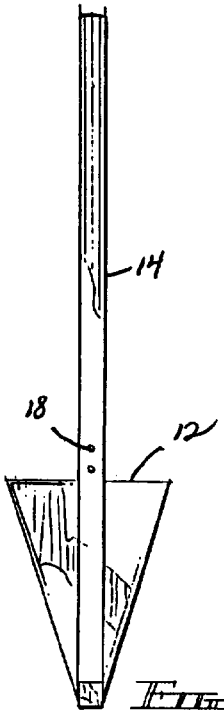
FIG. 2 and 3 are rear and side elevations of the apparatus illustrated in FIG. 1.
Figure 3:
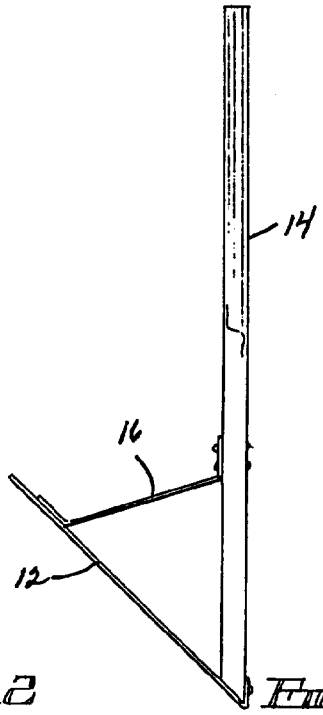
Figure 5:
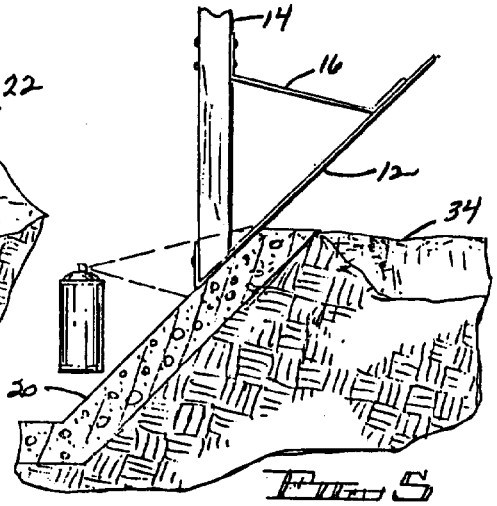
FIG. 5 is a cross-sectional view of an irrigation ditch such as that shown in FIG. 4, and illustrates the use of the apparatus of FIG. 1 to mark the locations of watering notches.

FIGS. 1–3 illustrate an apparatus 10 which is comprised of a trapezoidal plate 12, an elongate handle 14, and an interconnecting means in the form of a U-shaped bracket 16 which is rigidly connected to the handle by screws 18 and to the plate by weldments. The bracket 16 is suitably formed and dimensioned to provide an angle of forty-five degrees between the handle 14 and the plate 12. As illustrated in FIG. 5, the preferred angle is that which puts the handle 14 in approximately plumb position when the plate 12 is pressed against the inner wall 20 of a conventional irrigation ditch. The angle of the inner wall 20 may vary, being perhaps as low as thirty degrees, and the plumb position of the handle 14 is not necessary but provides ease in handling the apparatus 10. The bracket 16 may be provided in any shape or form which permits the plate and handle to be fixed to the desired angle.

Figure 4:
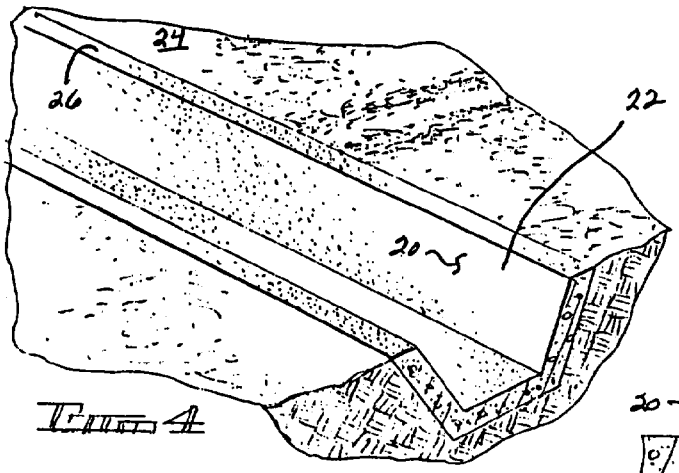
FIG. 4 is a partial perspective view of a conventional irrigation ditch.

FIG. 4 illustrates a conventional concrete irrigation ditch 22 disposed in a field 24. It will be observed that the ditch 22 has no watering notches, so that watering must be achieved by placing, between each row of crops, a hose that has one end extended into the ditch and the opposite end overlapping the top edge 26 and extending into the field 24.

Figure 6:
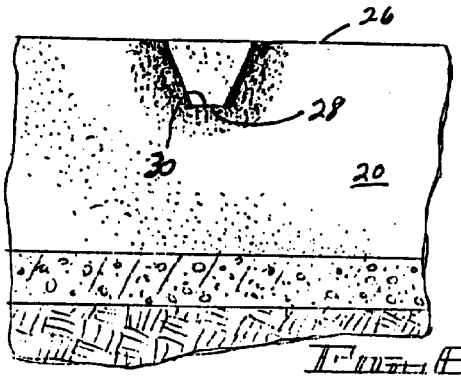
FIG. 6 is an elevation of the inner wall of the ditch shown in FIG. 5, and illustrates a marked location of a watering notch.

In use of the apparatus 10 of FIGS. 1–3, as illustrated in FIG. 5, the plate 12 is pressed against the inner wall 20 and overlaps the top edge 26 as shown. The inner wall 20 is then spray-painted around the plate 12, using the plate as a shield, to produce a marked outline 28 of the notch to be formed, as shown in FIG. 6. The marked outlines 28 are produced at an equally spaced plurality of locations along the ditch 22, with the spacing being determined by the spacing between successive rows of crops in the field 24. The bottoms 30 of the marked outlines 28 are optically determined by use of a conventional construction laser in a manner similar to that described in U.S. Pat. No. 5,248,217 Smith. The optical receiver (not shown) is mounted by any suitable means, such as taping, to the handle 14 of the apparatus 10.

Figure 7:
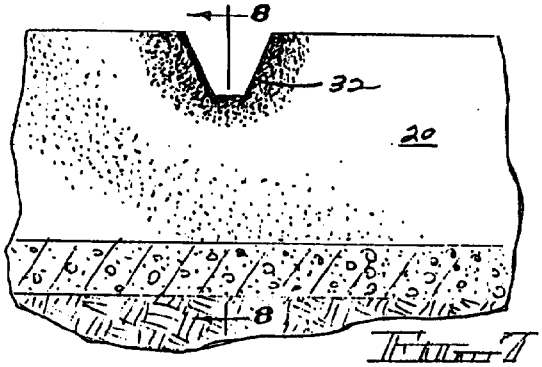
FIG. 7 is an elevation as in FIG. 6, showing the watering notch as formed after sawing through the inner wall.

After the marked outlines 28 are made, a rotary saw with a suitably robust blade (e.g., a diamond-tipped blade) is used to cut through the inner wall 20 along the outlines to produce the plurality of watering notches, as shown for a single notch 32 in FIG. 7.

Figure 8:
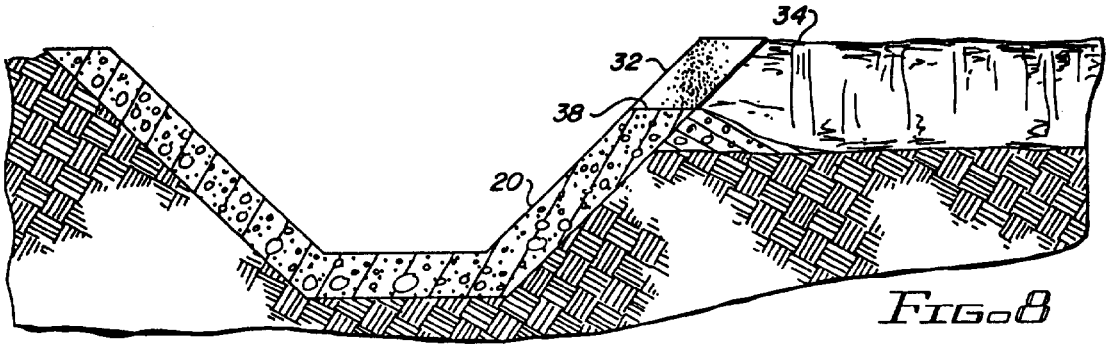
FIG. 8 is a cross-section taken along line 8—8 of FIG. 7.
Figure 9:
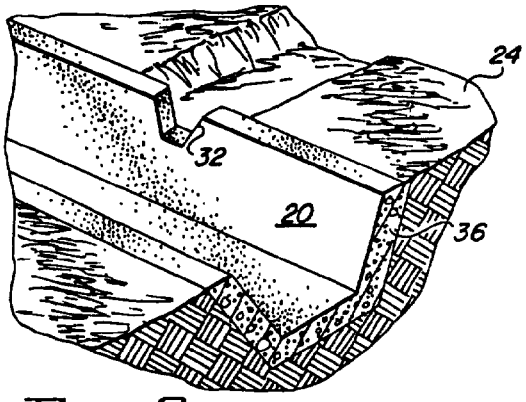
FIG. 9 is a partial perspective view of a ditch converted from conventional form to notched form.

The notch 32 is shown in FIG. 9 and, in cross-section, in FIG. 8. The soil 34 adjacent to the notch is subject to erosion if water is allowed to simply spill through the notch and into the field. Two problems result if that condition is permitted. First, erosion of the soil 34 will produce a hole that spreads the water as it comes through the notch 32, thus preventing more direct flow into the desired row. Second, the hole that results from erosion will produce a weak area of the inner wall 20 near the notch 32, since the soil serves to reinforce the wall. Accordingly, the converted irrigation ditch 36 (i.e., converted from conventional to notched form) will be subject to failure at a number of locations corresponding to the notches.

Figure 12:
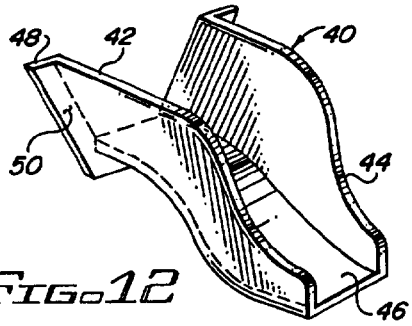
FIG. 12 is a perspective view of the spillway device illustrated in FIG. 11.
Figure 13:
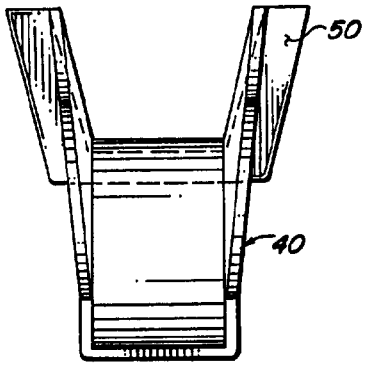
FIG. 13 is an elevation of the device shown in FIG. 12.

The easiest way I have found to solve this problem is to form a concrete spillway by depositing concrete on the bottom surface 38 of the notch 32, and along a continuous length extending several inches into the field 24. An alternative scheme is illustrated in FIGS. 11–13.

Figure 11:
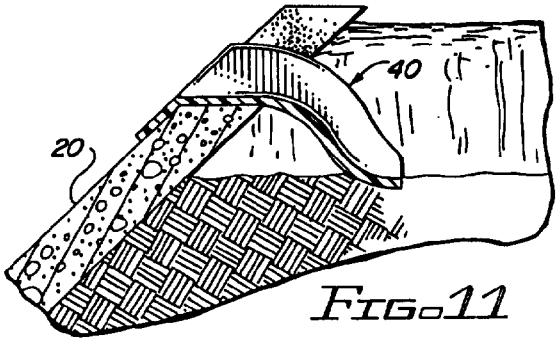
FIG. 11 is a cross-section of a notched irrigation ditch, illustrating the use of a spillway device in connection with a watering notch.

In FIG. 11, a preformed plastic spillway 40 is fixed to the inner wall 20 of the notch 32 by a suitable adhesive. The spillway 40 is formed to guide the flow of water onto the soil 34 at an angle which prevents erosion of the soil near the ditch 36. Viewing FIGS. 12 and 13, it can be seen that the spillway 40 is provided with sidewalls 42, 44 and a bottom wall 46 which serve to direct the water so as to avoid premature dispersion. A flange 48 comprises a U-shaped surface 50 to which an adhesive material is applied before fixing the spillway 40 to the inner wall 20.

Figure 10:
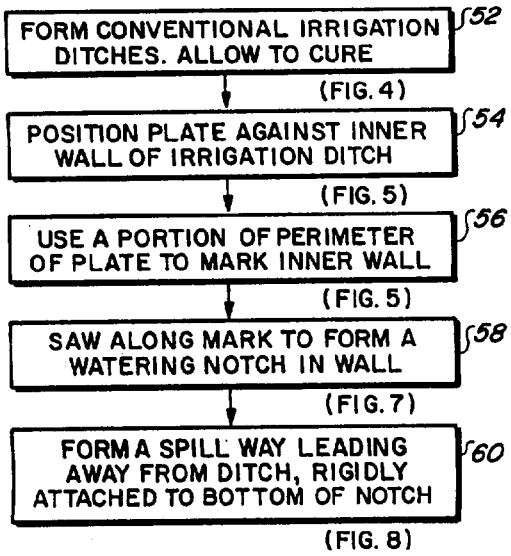
FIG. 10 is a flow diagram illustrating a preferred process in accord with the invention.

FIG. 10 is a diagram illustrating a process according to the invention. A conventional irrigation ditch is formed by conventional means as indicated at 52. After the ditch is allowed to cure, a plate (as at 12) is positioned at several equally-spaced locations against the inner wall of the ditch, preferably in the manner previously described (i.e., by use of optical positioning via a construction laser), as indicated by box 54. The inner wall is marked by use of the plate and by any of the means previously described, as indicated by box 56. The notches are then formed by sawing along the outlines of the plate as they appear on the inner wall, as indicated by box 58. Finally, a spillway is formed for each watering notch, and the spillways are rigidly adhered to the ditch at either the bottom surfaces of the notches (in the case of concrete spillways), or at the inner wall or the bottom surfaces of the notches, or both (in the case of plastic spillways), as indicated by box 60.

From the above description, it can be seen that the invention provides a novel and advantageous process for converting a conventional irrigation ditch to a notched irrigation ditch, and further provides apparatus for facilitating the process.

The foregoing description, taken in conjunction with the accompanying drawings and the following claims, is intended as illustrative rather than restrictive, since many equivalents could be employed without departing from the spirit and scope of the invention.

What is claimed is:

1. A process for forming watering notches through an existing concrete irrigation ditch which has an inner wall leading to a top edge, the edge being disposed toward a field to be irrigated, comprising the steps of:

optically determining a substantially common level for a plurality of spaced locations at which the notches are to be formed through the ditch;

at each of the locations, pressing against the inner wall a plate that has a peripheral form corresponding at least in part to a desired peripheral form for the notches, such that the peripheral form of the plate includes two lines leading toward the top edge;

at each of the locations, marking the peripheral form of the plate on the inner wall to produce a plurality of notch outlines; and cutting through the ditch along the notch outlines to form a spaced plurality of watering notches.

2. A process as recited in claim 1 further comprising the step of rigidly adhering a spillway to the ditch near each of the plurality of watering notches such that each spillway extends from its respective notch toward the field.

3. A process as recited in claim 2 wherein the step of adhering a spillway to the notches comprises depositing concrete on bottom surfaces of the notches and along continuous lengths extending toward the field.

4. A process as recited in claim 3 wherein the notch outlines are produced by spray painting the inner wall around the plate, using the plate as a shield.

5. A process as recited in claim 2 wherein the step of adhering a spillways to the ditch near each of the plurality of watering notches comprises applying an adhesive material to pre-formed spillway members and adhering the members to bottom surfaces of their respective notches.

6. A process as recited in claim 1 wherein the peripheral form of the plate is trapezoidal.

7. A process as recited in claim 1 wherein the notch outlines are produced by spray painting the inner wall around the plate, using the plate as a shield.

8. A process for forming a notched irrigation ditch, comprising the steps of:

forming a conventional unnotched irrigation ditch and allowing the ditch to cure;

marking a plurality of notch outlines on an inner wall of the conventional ditch; and cutting through the inner wall along the outlines to form the notched irrigation ditch.

9. A process as recited in claim 8 further comprising the step of fixing a plurality of spillways to the notched irrigation ditch to prevent soil erosion.

10. A process for forming watering notches at a plurality of locations through a conventional concrete irrigation ditch which has an inner wall leading to a top edge, the edge being disposed toward a field to be irrigated, comprising the steps of:

(a) providing a notch marking apparatus comprising a plate coupled to a handle, the plate having a peripheral form corresponding at least in part to a desired peripheral form for the notches, such that the peripheral form of the plate includes two lines leading toward the top edge;

(b) at each of the locations, optically determining the position of the plate on the inner wall by optically determining the appropriate vertical position of the handle coupled to the plate, the handle positioned in an approximate plumb position and extending upward from the plate;

(c) at each of the locations, pressing against the inner wall the plate of the notch marking apparatus;

(d) at each of the locations, marking the peripheral form of the plate on the inner wall to produce a plurality of notch outlines; and (d) cutting through the ditch along the notch outlines to form a spaced plurality of watering notches.

11. A process as recited in claim 10 further comprising the step of rigidly adhering a spillway to the ditch near each of the plurality of watering notches such that each spillway extends from its respective notch toward the field.

12. A process for forming watering notches at a plurality of locations through a conventional concrete irrigation ditch which has an inner wall leading to a top edge, the edge being disposed toward a field to be irrigated, comprising the steps of:

(a) providing a notch marking apparatus comprising a substantially trapezoidal plate coupled to a handle at an angle of 30 to 45 degrees, the handle including an optical receiver;

(b) at each of the locations, using a laser to determine the position of the plate on the inner wall by sighting the laser onto the optical receiver on the handle when the handle is positioned in an approximate plumb position extending upward from the plate;

(c) at each of the locations, pressing against the inner wall the plate of the notch marking apparatus;

(d) at each of the locations, spray painting around the perimeter of the plate to produce a plurality of notch outlines;

(e) cutting through the ditch along the notch outlines to form a spaced plurality of watering notches; and (f) rigidly adhering a spillway to the ditch near each of the plurality of watering notches such that each spillway extends from its respective notch toward the field.

* * * * *